US009175692B2

(12) United States Patent
Nowitzki et al.

(10) Patent No.: US 9,175,692 B2
(45) Date of Patent: Nov. 3, 2015

(54) MOTOR SHROUD FOR AN ELECTRIC SUBMERSIBLE PUMP

(71) Applicant: Summit ESP, LLC, Tulsa, OK (US)

(72) Inventors: Wesley John Nowitzki, Broken Arrow, OK (US); Gregory Austin Davis, Broken Arrow, OK (US); Randy S. Roberts, Tulsa, OK (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/590,775

(22) Filed: Jan. 6, 2015

(65) Prior Publication Data

US 2015/0192141 A1 Jul. 9, 2015

Related U.S. Application Data

(60) Provisional application No. 61/924,836, filed on Jan. 8, 2014.

(51) Int. Cl.

| | |
|---|---|
| ***F04D 29/10*** | (2006.01) |
| ***F04D 1/06*** | (2006.01) |
| ***F04D 13/10*** | (2006.01) |
| ***E21B 43/12*** | (2006.01) |
| ***F04D 13/08*** | (2006.01) |

(52) U.S. Cl.

CPC ..... *F04D 29/108* (2013.01); *E21B 43/121* (2013.01); *F04D 1/06* (2013.01); *F04D 13/086* (2013.01)

(58) Field of Classification Search

CPC ..... E21B 43/128; F04D 13/086; F04D 13/10; F04D 13/08; F04D 29/086; F04D 29/4286; F04D 29/108

USPC ..... 417/423.3, 424.2; 166/105, 105.5, 66.4, 166/104; 277/343, 322, 323; 285/294.3, 285/296.1

See application file for complete search history.

(56) References Cited

U.S. PATENT DOCUMENTS

| | | | | | |
|---|---|---|---|---|---|
| 1,776,797 | A | * | 9/1930 | Sheldon | 277/329 |
| 2,759,254 | A | * | 8/1956 | Soehnlen et al. | 29/890.147 |
| 3,331,621 | A | * | 7/1967 | Bagnulo | 285/47 |
| 3,731,710 | A | * | 5/1973 | Bauer et al. | 138/143 |
| 3,748,066 | A | * | 7/1973 | Sully et al. | 417/423.3 |

(Continued)

OTHER PUBLICATIONS

ITW Evercoat, "Material Safety Data Sheet," Product Brochure, taken from http://www.evercoat.com/imgs/msds/MSDS%20100654%20sealant%20foam%2001142010.pdf, May 9, 2011, 7 pages.

*Primary Examiner* — Alexander Comley

(74) *Attorney, Agent, or Firm* — Frederic Dorwart, Lawyers; Penina Michlin Chiu

(57) ABSTRACT

A motor shroud for an electric submersible pump is described. A motor shroud includes a shroud collar secured around a base of a centrifugal pump, the shroud collar including a plurality of sealant pathways extending around an inner surface and an outer surface of the shroud collar, wherein at least one of the plurality of sealant pathways has an aperture extending radially through the shroud collar between the inner surface and the outer surface, a shroud hanger tubularly surrounding the outer surface and fixedly coupled to a shroud jacket, the shroud hanger including a sealant entry port, and a sealant occupying a first space between the shroud hanger and the shroud collar and a second space between the shroud collar and an intake of the centrifugal pump, wherein the sealant cures from an aerosol spray to form a hardened foam barrier to a flow of well fluid.

18 Claims, 8 Drawing Sheets

(56) References Cited

U.S. PATENT DOCUMENTS

| | | | | | |
|---|---|---|---|---|---|
| 3,860,270 | A * | 1/1975 | Arnold | 277/625 |
| 3,916,502 | A * | 11/1975 | Bagnulo | 29/890.14 |
| 3,960,394 | A * | 6/1976 | Hubner et al. | 285/296.1 |
| 4,015,633 | A * | 4/1977 | Mandell | 138/89 |
| 4,275,319 | A * | 6/1981 | Davis, Jr. | 310/43 |
| 4,323,526 | A * | 4/1982 | Hilbush, III | 264/36.16 |
| 4,530,397 | A * | 7/1985 | Calhoun | 166/84.2 |
| 4,605,466 | A * | 8/1986 | Eisenzimmer | 156/293 |
| 4,696,324 | A * | 9/1987 | Petronko | 137/375 |
| 4,751,965 | A * | 6/1988 | Cassity | 166/182 |
| 4,804,209 | A * | 2/1989 | Fischer | 285/31 |
| 4,806,083 | A * | 2/1989 | LaGrange et al. | 417/423.14 |
| 4,966,532 | A * | 10/1990 | Fengsheng | 417/366 |
| 5,355,961 | A * | 10/1994 | Gariepy et al. | 166/387 |
| 5,456,314 | A * | 10/1995 | Boehm | 166/208 |
| 5,464,063 | A * | 11/1995 | Boehm, Jr. | 166/382 |
| 5,478,123 | A * | 12/1995 | Kanao | 285/291.1 |
| 5,853,643 | A * | 12/1998 | Bauer | 264/272.15 |
| 5,992,517 | A * | 11/1999 | McAnally | 166/105 |
| 6,003,873 | A * | 12/1999 | Solberg | 277/323 |
| 6,364,013 | B1 * | 4/2002 | Watson et al. | 166/105 |
| 6,595,295 | B1 * | 7/2003 | Berry et al. | 166/369 |
| 6,602,059 | B1 * | 8/2003 | Howell et al. | 417/423.3 |
| 6,691,782 | B2 * | 2/2004 | Vandevier | 166/265 |
| 7,014,219 | B2 * | 3/2006 | Hoppenz et al. | 285/296.1 |
| 7,407,165 | B1 * | 8/2008 | Chisnell | 277/603 |
| 7,766,081 | B2 * | 8/2010 | Brown et al. | 166/105.5 |
| 7,882,896 | B2 * | 2/2011 | Wilson et al. | 166/368 |
| 8,141,625 | B2 * | 3/2012 | Reid | 166/105.5 |
| 8,397,811 | B2 * | 3/2013 | Reid | 166/265 |
| 8,435,015 | B2 * | 5/2013 | Brookbank et al. | 417/369 |
| 2005/0194126 | A1 * | 9/2005 | Wang | 166/105 |
| 2006/0245957 | A1 * | 11/2006 | Berry et al. | 417/423.3 |
| 2009/0053080 | A1 * | 2/2009 | Ives et al. | 417/410.1 |
| 2009/0223662 | A1 * | 9/2009 | Shaw et al. | 166/250.15 |
| 2009/0272538 | A1 * | 11/2009 | Kennedy | 166/369 |
| 2010/0096141 | A1 * | 4/2010 | Brown et al. | 166/369 |
| 2010/0122818 | A1 * | 5/2010 | Rooks | 166/369 |
| 2011/0024124 | A1 * | 2/2011 | Brown et al. | 166/369 |
| 2011/0073296 | A1 * | 3/2011 | Richard et al. | 166/56 |
| 2011/0127045 | A1 * | 6/2011 | Spence et al. | 166/379 |
| 2012/0195775 | A1 * | 8/2012 | Pedrollo | 417/423.3 |
| 2013/0068455 | A1 * | 3/2013 | Brown et al. | 166/265 |
| 2015/0053414 | A1 * | 2/2015 | Reid | 166/372 |

* cited by examiner

MOTOR SHROUD FOR AN ELECTRIC SUBMERSIBLE PUMP

CROSS REFERENCE TO RELATED APPLICATIONS

This application claims the benefit of U.S. Provisional Application No. 61/924,836 to Nowitzki et al., filed Jan. 8, 2014 and entitled "SYSTEM, APPARATUS AND METHOD FOR SEALING A MOTOR SHROUD," which is hereby incorporated by reference in its entirety.

BACKGROUND OF THE INVENTION

1. Field of the Invention

Embodiments of the invention described herein pertain to the field of submersible pump assemblies. More particularly, but not by way of limitation, one or more embodiments of the invention enable a motor shroud for an electric submersible pump.

2. Description of the Related Art

Submersible pump assemblies are used to artificially lift fluid to the surface in deep wells such as oil or water wells. A typical electric submersible pump (ESP) assembly consists, from bottom to top, of an electric motor, seal section, pump intake and centrifugal pump, which are all connected together with shafts. The electric motor supplies torque to the shafts, which provides power to the centrifugal pump. The electric motor is generally a two-pole, three-phase, squirrel cage induction design connected to a power source located at the surface of the well using a motor lead cable. The entire assembly is placed into the well inside a casing, which casing separates the submersible pump assembly from the well formation. Perforations in the casing allow well fluid to enter the casing. These perforations are generally below the motor and are advantageous for cooling the motor when the pump is in operation, as fluid is drawn passed the outside of the motor as it makes it way from the perforations up to the pump intake.

One challenge to economic and efficient ESP operation is pumping gas-laden fluid. When pumping gas-laden fluid, the gas may separate from the other fluid due to the pressure differential created when the pump is in operation. If there is a sufficiently high gas volume fraction, typically about 10% or more, the pump may experience a decrease in efficiency and decrease in capacity or head (slipping). If gas continues to accumulate on the suction side of the impeller it may entirely block the passage of other fluid through the centrifugal pump. When this occurs the pump is said to be "gas locked" since proper operation of the pump is impeded by the accumulation of gas. As a result, careful attention to gas management in submersible pump systems is needed in order to improve the production of gas-laden fluid from subsurface formations.

Conventionally in wells with gas-laden fluid, perforations in the well assembly casing are sometimes placed above the pump intake, rather than below the motor. In such instances, a shroud is placed around the pump base, intake, and motor lead cable, which shroud includes a jacket (a length of tubing) that extends below the motor, in order to prevent fluid from entering through the perforations and proceeding directly to the pump intake. Instead, once the fluid enters the perforations the liquid is forced downward in between the shroud and casing. In the process, a portion of the gas breaks out of the laden fluid prior to entry into the pump and naturally rises up the open casing annulus to the surface, instead of down to the bottom of the shroud with the liquid. Once the liquid reaches the end of the shroud jacket it makes a 180 degree turn, is forced upward, and enters the inside of the shroud by the motor. This configuration still maintains the advantageous motor cooling, as the well fluid will now pass over the outside of the motor as it makes its way into the pump via the intake, whilst beneficially separating some gas from the laden fluid.

A drawback to the use of a shroud is that conventional shrouds are prone to leaks. If well fluid were to leak directly into the pump, the fluid would bypass the motor, which would be at risk of overheating or failure due to the lack of cool, fresh flowing fluid passing by during operation. Those portions of the shroud surrounding the motor lead cable and intake section are particularly prone to leakage.

One conventional approach to protect against leaks in the shroud is the addition of layered and slotted rubber material that squeezes around the motor lead cable and intake section to provide a positive seal. However, handling and fitting up the rubber material is difficult and extremely time consuming because of the tight fitting clearances, and if the weather is cold such as below 32° F., the cold weather makes it difficult to squeeze the rubber in the fashion necessary to create the positive seal. Even if the rubber material is installed, it is limited in surface area. Another approach has been to use tape to fill voids in the shroud, but the tape is also temperamental under temperature extremes, such as below 32° F. or above 100° F.

It would be an advantage for motor shrouds to be resistant to leaks, and expeditious and simple to install at the well site despite extreme weather conditions. Therefore, there is a need for a motor shroud for electric submersible pumps.

BRIEF SUMMARY OF THE INVENTION

A motor shroud for an electric submersible pump is described. An illustrative embodiment of a motor shroud comprises a shroud collar secured around a base of a centrifugal pump, the shroud collar comprising a first plurality of sealant pathways extending around an inner surface of the shroud collar and a second plurality of sealant pathways extending around an outer surface of the shroud collar, wherein at least one of the second plurality of sealant pathways has an aperture extending radially through the shroud collar between the inner surface and the outer surface of the shroud collar, a shroud hanger tubularly surrounding the outer surface and fixedly coupled to a shroud jacket, the shroud hanger comprising a sealant entry port, the shroud jacket extending below an electric motor that turns the centrifugal pump, and a sealant occupying a first space between the shroud hanger and the shroud collar and a second space between the shroud collar and an intake of the centrifugal pump, wherein the sealant cures from an aerosol spray to form a hardened foam barrier to a flow of well fluid. In some embodiments, the sealant comprises a closed cell polyurethane foam. In certain embodiments, the motor shroud further comprises a pair of containment grooves sandwiching the second plurality of sealant pathways. In some embodiments, the aperture extends radially between one of the first plurality of sealant pathways and one of the second plurality of sealant pathways.

An illustrative embodiment of a downhole pumping system comprises a vertical pump assembly downhole in a well casing, the well casing comprising perforations above an intake of the pump assembly, a motor shroud extending tubularly about the pump assembly from a base of a centrifugal pump to a pump motor operatively coupled to the centrifugal pump, the tubular motor shroud comprising a split collar secured to the base of the centrifugal pump, a hanger secured around the split collar on a top side and fixedly coupled to shroud jacket on a bottom side, and a foam sealant expanded into one of a first area between a motor lead cable and the split collar, a second area between the split collar and the intake, a third area between the split collar and the hanger, or a combination thereof, wherein the foam sealant cures to form a hardened barrier to well fluid, and wherein the well fluid enters the well casing through the perforations and flows inside the tubular motor shroud passed the motor of the pump assembly prior to entering the intake of the pump assembly. In some embodiments, the split collar further comprises a first sealant pathway extending circumferentially about an outer diameter, and a second sealant pathway extending circumferentially about an inner diameter, the second sealant pathway extending about the inner diameter of the split collar fluidly coupled to the first sealant pathway extending about the outer diameter by an aperture. In certain embodiments, the hanger further comprises a sealant entry port and the sealant foam is sprayed through a nipple attached to the sealant entry port. In some embodiments, the system further comprises a foam sealant pathway leading to the second area between the intake and the split collar, wherein the foam sealant pathway is sandwiched between a pair of containment grooves.

An illustrative embodiment of an electric submersible pump (ESP) assembly comprises a shroud collar bolted around an ESP, the shroud collar comprising an inner surface extending axially on an inner diameter of the shroud collar, an outer surface extending axially on an outer diameter of the shroud collar, at least one first circumferential sealant pathway groove extending around the inner surface, at least one second circumferential sealant pathway groove extending around the outer surface, at least one aperture extending radially between the at least one first and second sealant pathway grooves, a first pair of sealant containment grooves sandwiching the at least one first circumferential sealant pathway groove on the inner surface, a second pair of sealant containment grooves sandwiching the at least one second circumferential sealant pathway groove on the outer surface, and each containment groove of the first and second pair of sealant containment grooves comprising an elastomeric ring fitted therein. In some embodiments, the assembly further comprises a hardened polyurethane closed-cell foam sealant adhereingly coupled to the ESP, the at least one first and second circumferential sealant pathway grooves and the at least one aperture. In certain embodiments, the assembly comprises a hanger bolted to the shroud collar, and wherein the hardened polyurethane closed-cell foam sealant is adhereingly coupled to the hanger. In some embodiments, at least one of the elastomeric rings has an opening around motor lead cable of the ESP.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
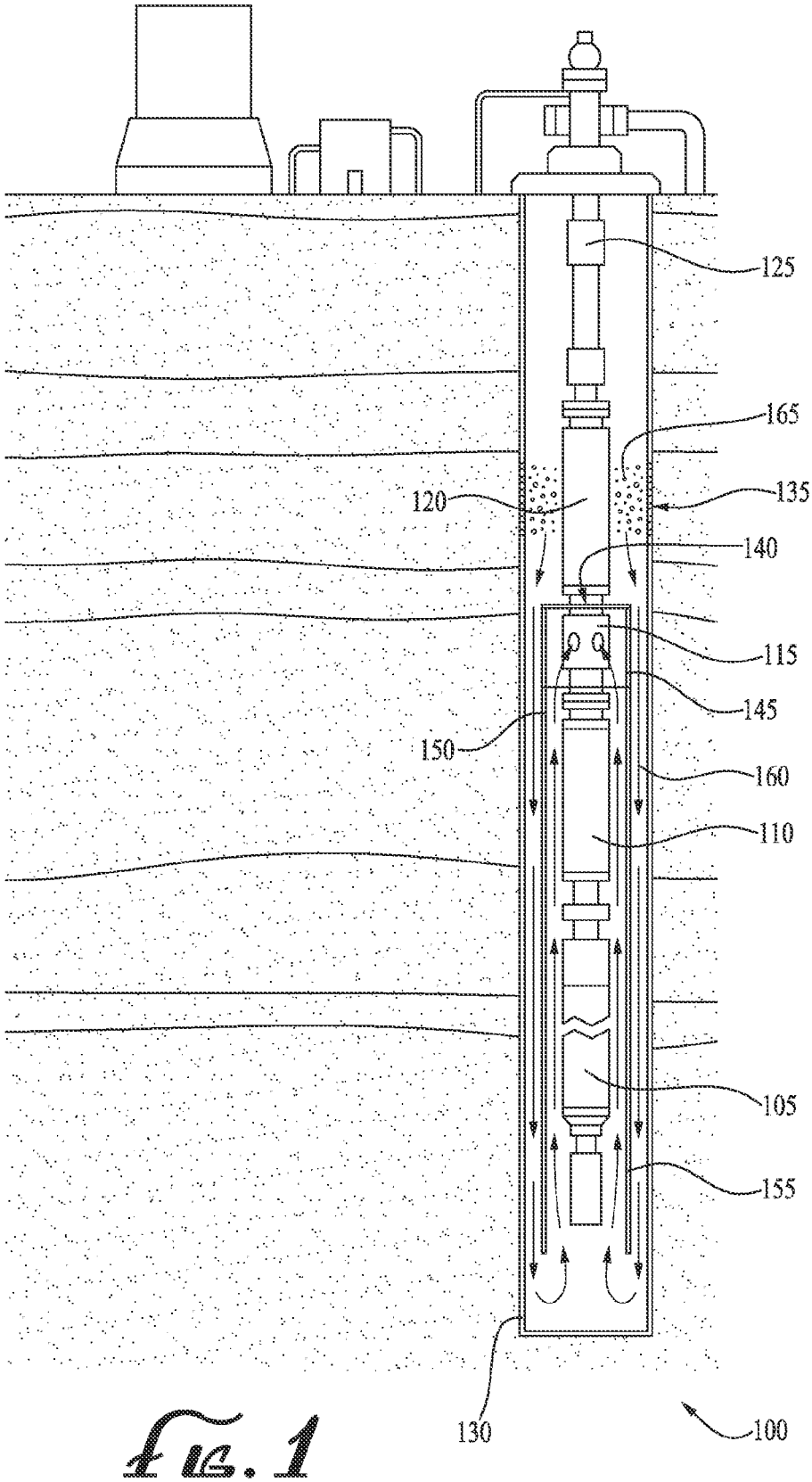
FIG. 1 is a cross sectional view of an illustrative embodiment of a submersible pump assembly with a motor shroud and illustrating an exemplary well-fluid flow path of an illustrative embodiment.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

A motor shroud for an electric submersible pump will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a pathway may also refer to multiple pathways.

"Coupled" refers to either a direct connection or an indirect connection (e.g., at least one intervening connection) between one or more objects or components. The phrase "directly attached" means a direct connection between objects or components.

"Downstream" refers to the direction substantially with the primary flow of fluid when the centrifugal pump is in operation. Thus by way of example and without limitation, in a vertical downhole ESP assembly, the downstream direction may be towards the surface of the well.

"Upstream" refers to the direction substantially opposite the primary flow of fluid when the centrifugal pump is in operation. Thus by way of example and without limitation, in a vertical downhole ESP assembly, the upstream direction may be towards the bottom of the well.

As used in this specification and the appended claims, the terms "inner" and "inwards" with respect to a collar or other pump assembly component refer to the radial direction towards the center of the shaft of the pump assembly.

As used in this specification and the appended claims, the terms "outer" and "outwards" with respect to a collar or other pump assembly component refer to the radial direction away from the center of the shaft of the pump assembly.

Illustrative embodiments of the invention described herein may seal a motor shroud, preventing at least a portion of well fluid from entering into an electric submersible pump (ESP) without first flowing past the submersible motor. A semi-solid sealant, such as a foam sealant, may be sprayed and/or inserted into a port in the shroud hanger that surrounds the shroud collar. The shroud collar may be secured to the pump base and may include pathways to guide the sealant to areas of the shroud around the motor lead cable and intake that are prone to leaks. The collar may also include containment grooves with elastomeric rings therein to contain the sealant within desired areas of the pump assembly. Once inserted into the shroud, the sealant may expand, cure and become a hardened barrier impermeable to well fluid, which sealant may adhere to pump components. In one example, the sealant may harden within about 15-20 minutes from insertion. The hardened sealant may form a solidified barrier to well fluid leaks, forcing the well fluid to pass the motor prior to entering the pump, and allowing the well fluid to cool the motor of the pump assembly. While the invention is described in terms of an ESP application for pumping oil or water, nothing herein is intended to limit the invention to those embodiments.

FIG. 1 is an illustrative embodiment of a submersible pump assembly with shroud. ESP assembly 100 is located in an underground well, and is oriented vertically or substantially vertically within the well such that ESP motor 105 is the deepest component of the ESP assembly within the well, other than downhole sensors. ESP motor 105 may be a two-pole, three-phase squirrel cage induction motor. Downstream of ESP motor 105 is seal section 110 that carries the thrust of centrifugal pump 120, equalizes pressure and provides motor oil to ESP motor 105. ESP intake 115 may be downstream of ESP seal section 110 and serves as the intake for well fluid into the pump assembly. ESP intake 115 may include intake ports and/or a slotted or perforated screen. ESP pump 120 may be a multi-stage centrifugal pump that accelerates pumped fluid with impeller and diffuser stages. ESP pump 120 is downstream of intake 115. Production tubing 125 carries pumped well fluid to the surface. In some embodiments, a gas separator or charge pump (not shown) may also be incorporated into the assembly 100 to further improve gas handling capabilities.

ESP assembly 100 is surrounded by casing 130. As shown in FIG. 1, casing 130 contains perforations 135 to allow well fluid 160 from the underground formation to be drawn into the pump 120 for collection. Perforations 135 may be located above and/or downstream of ESP intake 115, due to a high gas content in produced well fluid 160, typically about 10% or more gas to volume ratio. Shroud 150 may be attached to the assembly 100 at the base of centrifugal pump 120 and extend upstream below motor 105. As illustrated by the arrows shown in FIG. 1, when shroud 150 is sealed using illustrative embodiments, well fluid 160 enters perforation 135, travels down the wellbore between casing 130 and shroud 150 to below motor 105, and is then directed inside shroud jacket 155, past motor 105 and into intake 115 for production. This configuration may allow gas 165 to break out of produced fluid as the well fluid 160 travels down the wellbore, and allows the well fluid to cool motor 105 as the well fluid travels inside shroud 150 to intake 115.

Figure 2A:
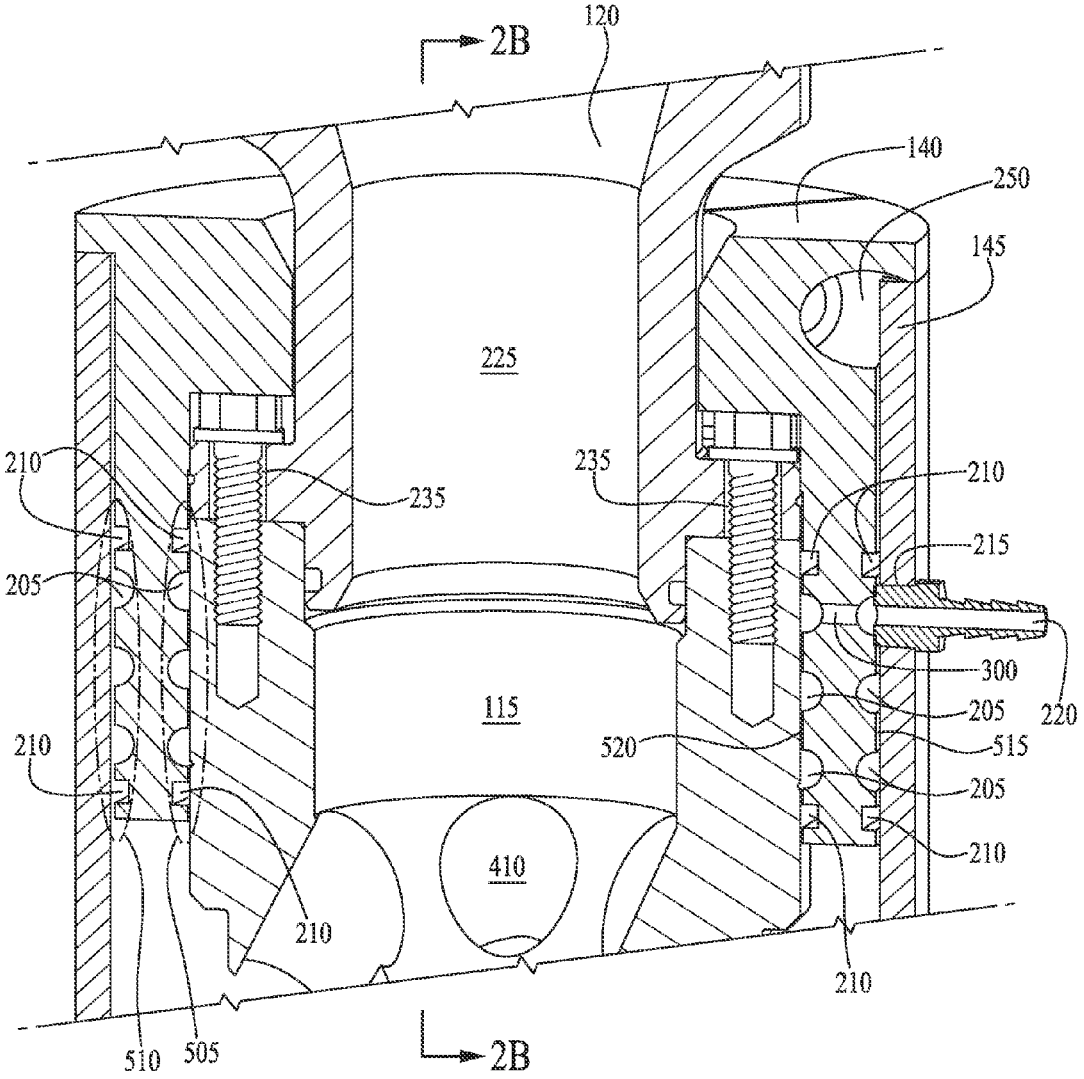
FIG. 2A is a cross sectional view of a centrifugal pump base with an illustrative embodiment of a motor shroud collar and hanger.
Figure 2B:
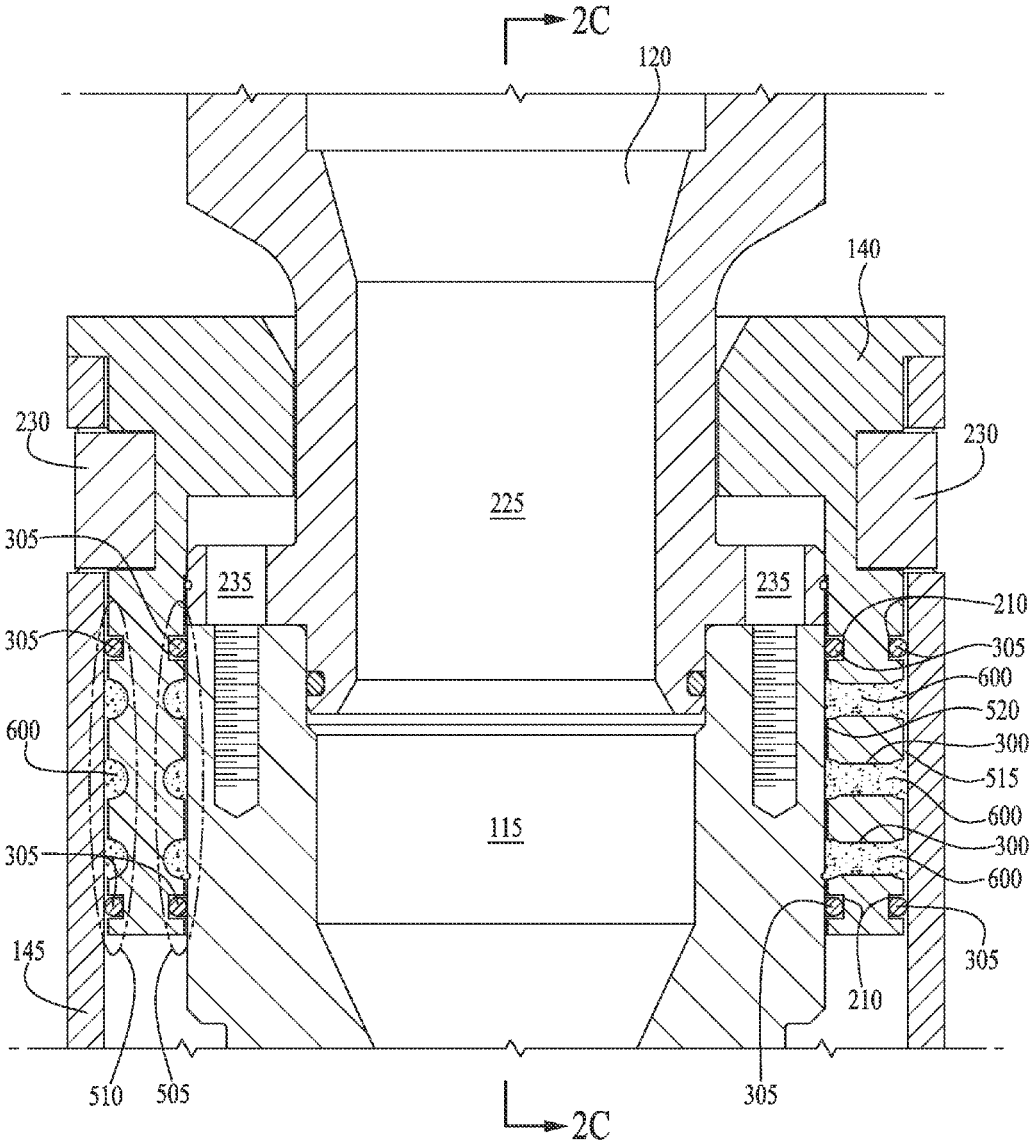
FIG. 2B is a cross sectional view across line 2B-2B of FIG. 2A of a centrifugal pump base with an illustrative embodiment of a motor shroud collar and hanger with sealant inserted.
Figure 2C:
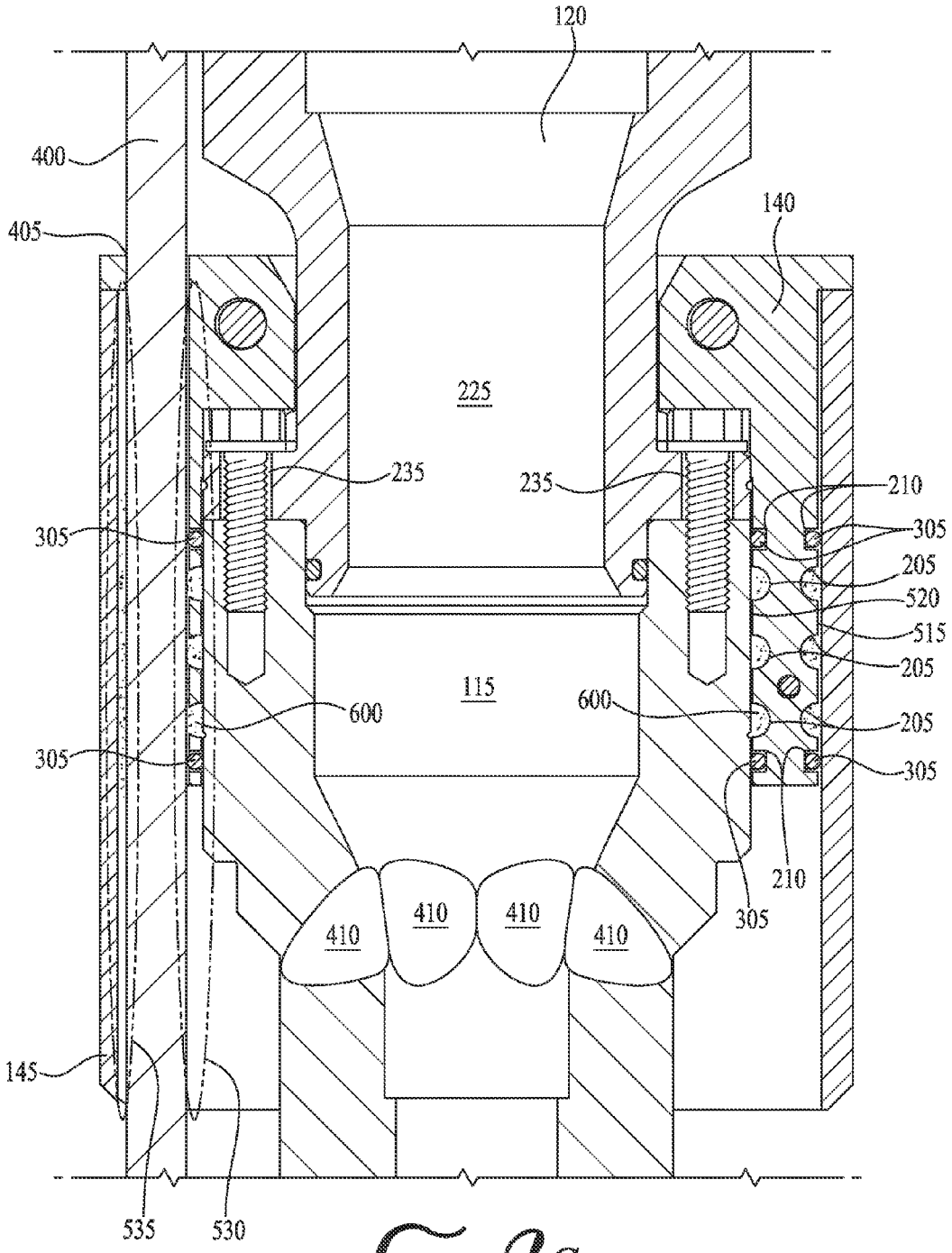
FIG. 2C is a cross sectional view across line 2C-2C of FIG. 2B of a centrifugal pump base with an illustrative embodiment of a motor shroud collar and hanger around a motor lead cable.

FIGS. 2A-2C are an illustrative embodiment of a centrifugal pump base with shroud. This illustrative embodiment shows locations that may be most prone to leak well fluid prematurely into the pump assembly 100, and that may be sealed using illustrative embodiments. For illustration purposes, FIG. 2A is shown without sealant inserted, and FIGS. 2B and 2C are shown with sealant 600 included. Illustrative areas (spaces) most prone to shroud leaks may include: first area 505 between collar 140 and intake 115, second area 510 between collar 140 and hanger 145, third area 530 between motor lead cable 400 and collar 140 and/or fourth area 535 between motor lead cable 400 and hanger 145. Various embodiments may be used to better seal leaks in any or all of these spaces.

Figure 5:
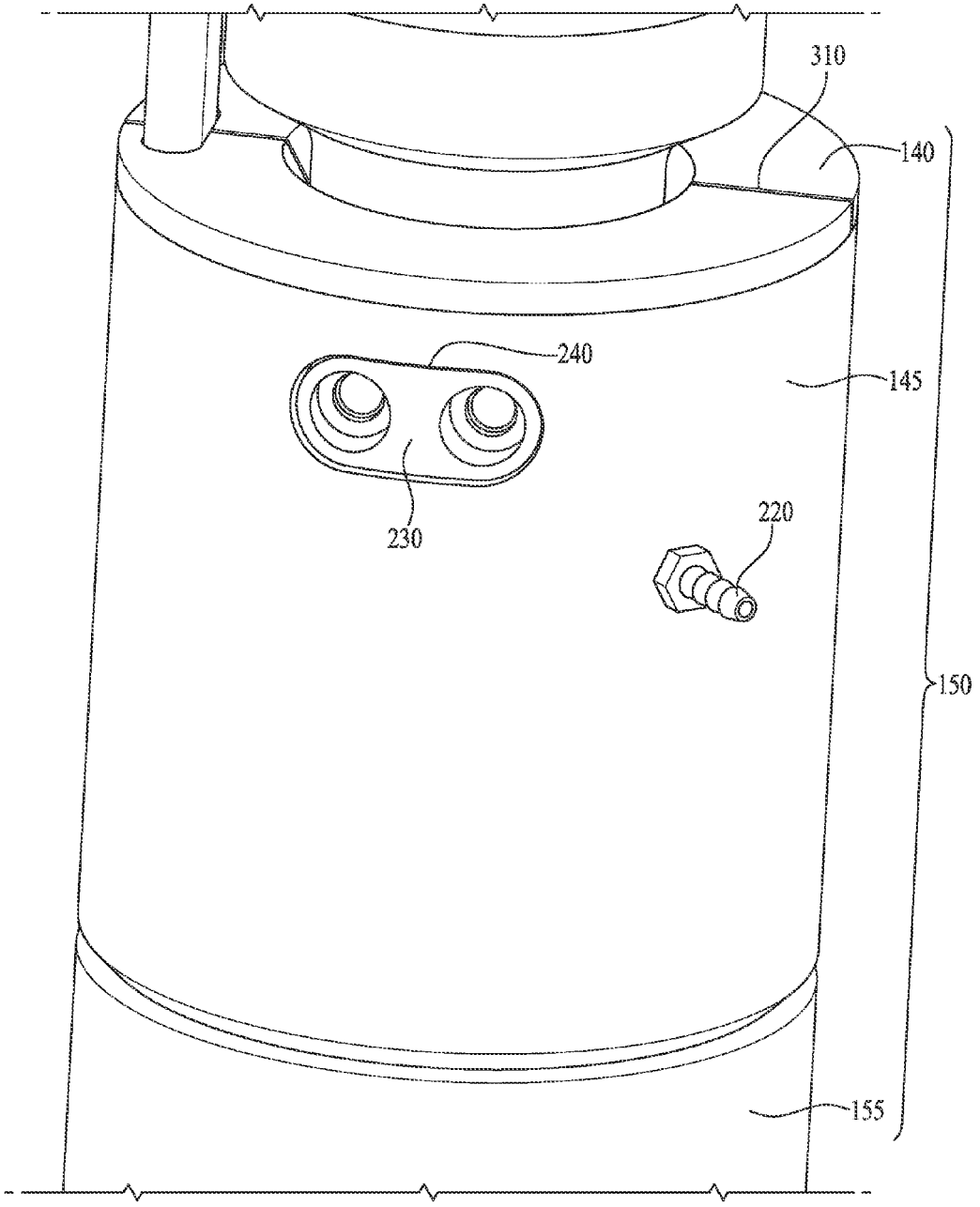
FIG. 5 is a perspective view of an illustrative embodiment of an installed hanger with sealant port.

Shroud 150 may include collar 140, hanger 145 and jacket 155, as shown in FIG. 5. Collar 140 may be clamped to base 225 (shown in FIG. 2A) of centrifugal pump 120 and/or bolted in place, or otherwise attached to base 225 of centrifugal pump 120 with attachment techniques known to those of skill in the art. In some embodiments, after casting, collar 140 may be machined into two or more pieces (split) to provide for easy installment, such as bolting and/or clamping of collar 140 around base 225 at the well site.

Returning to FIGS. 2A-2C, collar 140 may rest on bolts 235 once installed. In some embodiments, collar 140 may be clamped and/or bolted at both the top and/or bottom side of collar 140. A bolt through a recess 250 placed at the top and/or bottom of collar 140 at a location of a split 310 (shown in FIG. 3) may assist in preventing separation or movement of collar 140 when installed. Collar 140 may cover base 225 of centrifugal pump 120, and/or surround or cover motor lead cable 400, and/or a portion of intake 115 downstream of intake port 410. Collar 140 may include axial slot 405 to accommodate motor lead cable 400.

Collar 140 and/or hanger 145 may contain features that facilitate insertion and placement of sealant 600 of illustrative embodiments to seal spaces about shroud 150 that may be prone to leaks. Sealant 600 may be inserted into shroud 150 through entry port 215 in hanger 145. Entry port 215 may be an opening in hanger 145, into which nipple 220 may be inserted and/or attached. Collar 140 may include pathways 205 such as protrusions and/or grooves cast or machined about the outer surface 515 and/or inner surface 520 of collar 140. Pathways 205 may provide a flow path for sealant 600, and assist in guiding the flow of sealant 600 to areas that may be prone to leakage. For example, third area 530 and fourth area 535 around motor lead cable 400, first area 505 between collar 140 and intake 115 and/or second area 510 between collar 140 and hanger 145 are all prone to leaks without the illustrative embodiments described herein. In some embodiments, pathways 205 may be circular or circumferential paths around the outer surface 515 (outer circumference) and/or inner surface 520 (inner circumference) of collar 140. In some embodiments, pathways 205 may spiral around inner surface 520 and/or outer surfaces 515 of collar 140. Pathways 205 may be vertical or diagonal axial grooves or protuberances, or form such other shapes or patterns on the surface(s) of collar 140 and/or hanger 145 to guide sealant to the desired location about collar 140, hanger 145, motor lead cable 400, base 225 and/or intake 115. FIGS. 2B and 2C illustrate an example of sealant 600 hardened within pathways 205 and apertures 300 that guide sealant to areas prone to leaks.

In one exemplary embodiment shown in FIGS. 2A-2C, three circular pathways 205 may be employed in series on each of inner surface 520 and outer surface 515. In some embodiments, cross-drilled apertures 300 (shown in FIGS. 2B and 3), drilled radially through the wall of collar 140 between inner surface 520 and outer surface 515, may allow sealant to flow to the inner surface 520 of collar 140, enabling the sealant 600 to seal both inner surface 520 and outer surfaces 515 of collar 140. These apertures 300 may, for example, allow sealant 600 to reach first space 505 between intake 115 and collar 140. Apertures 300 may be located on, along or proximate pathways 205 to assist in ensuring that sealant 600 is guided through apertures 300 to inner surface 520 after sealant 600 is inserted through entry port 215 and/or nipple 220 in one or more embodiments. In some embodiments, apertures 300 may extend between pathways 205 on inner surface 520 and outer surface 515 so as to connect the pathways on both surfaces.

One or more containment grooves 210 may be cast or machined into inner surface 520 and/or outer surface 515 of collar 140. Containment groove 210 may accommodate elastomeric ring 305 (shown in FIG. 2B), such as an o-ring, to at least partially contain the flow of sealant 600 beyond those location(s) where the sealant is desirable. Elastomeric ring 305 is shown in FIG. 2B, but has been omitted from FIG. 2A for purposes of illustrating containment groove 210. Containment groove 210 and/or elastomeric ring 305 may assist in limiting the quantity of sealant 600 flowing during insertion into intake port 410 (shown in FIG. 2A) on the upstream portion of intake 115 and/or areas on or above base 225 of centrifugal pump 120 not prone to leakage and/or where sealant 600 is not needed. In one example as shown in FIGS. 2A-2C and 3, a pair of containment grooves 210 may be employed on each of inner surface 520 and outer surface 515 and arranged such that containment grooves 210 sandwich pathways 205 on a top and bottom side. Containment grooves 210 may extend around outer surface 515 and inner surface 520 of collar 140 in a circumferential fashion.

Figure 6:
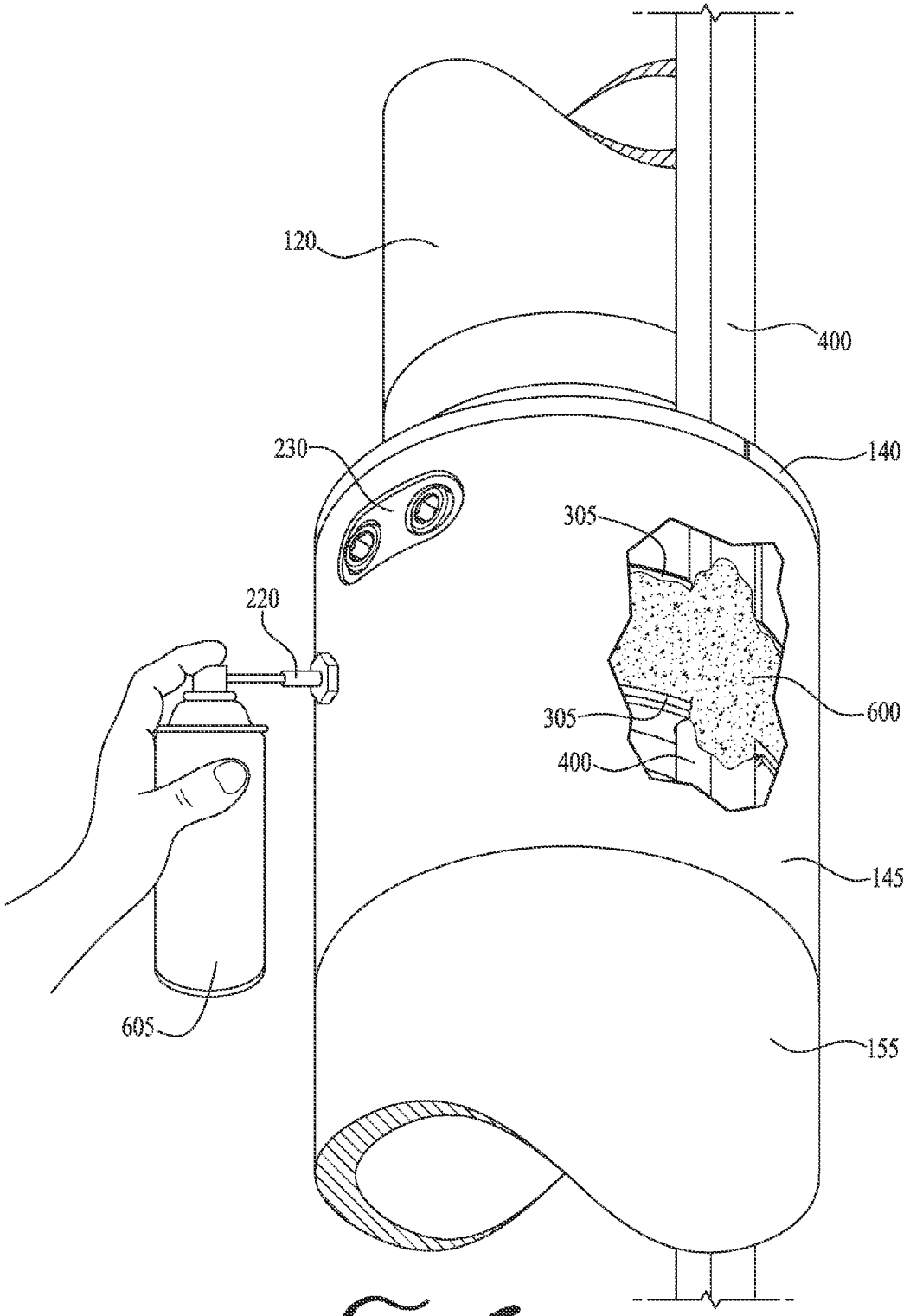
FIG. 6 is a perspective view of an illustrative embodiment of the process of inserting sealant foam into a submersible pump assembly with collar and hanger.

Containment grooves 210 and/or pathways 205 may be rounded or square when viewed in cross section. For example, as shown in FIGS. 2A-2C, pathways 205 are rounded and containment grooves 210 are squared. In elastomeric ring embodiments, containment grooves 210 should be deep enough to accommodate elastomeric ring 305. Elastomeric rings 305 may be cut at assembly for installation so that elastomeric rings 305 may be wrapped around containment grooves 210. If cut, elastomeric ring 305 holds its shape, and containment grooves 210 and/or hanger 145 may hold elastomeric rings 305 in place. Grease may also be employed to hold elastomeric rings 305 in the desired location. As shown in FIG. 6, openings in elastomeric ring 305, which may be created from incisions, may be positioned to allow motor lead cable 400 to pass through. As a result, there may be some expansion of sealant 600 around the motor lead cable 400, and this seepage of sealant 600 may provide a sealing benefit as sealant 600 surrounds motor lead cable 400 travelling axially up and/or down motor lead cable 400, as well as around it. Illustrative seepage of sealant 600 around motor lead cable 400 is illustrated in FIG. 6. In alternative embodiments, rather than being cut, elastomeric rings 305 may be threaded (stretched) through the pump string. If threaded, care should be taken not to overstretch elastomeric rings 305.

Containment groove 210 and/or elastomeric ring 305 are not intended to provide a sealing function for well fluid, particularly in embodiments where elastomeric rings 305 are cut during installation. Instead, these containment features may be implemented to assist in directing the primary flow of sealant 600. In such embodiments, containment groove 210 and/or elastomeric ring 305 need not provide a complete barrier to the flow of sealant 600. Some sealant 600 may bypass containment groove 210 and/or elastomeric ring 305 without impairing the effectiveness of shroud 150 and/or ESP assembly 100.

Figure 3:
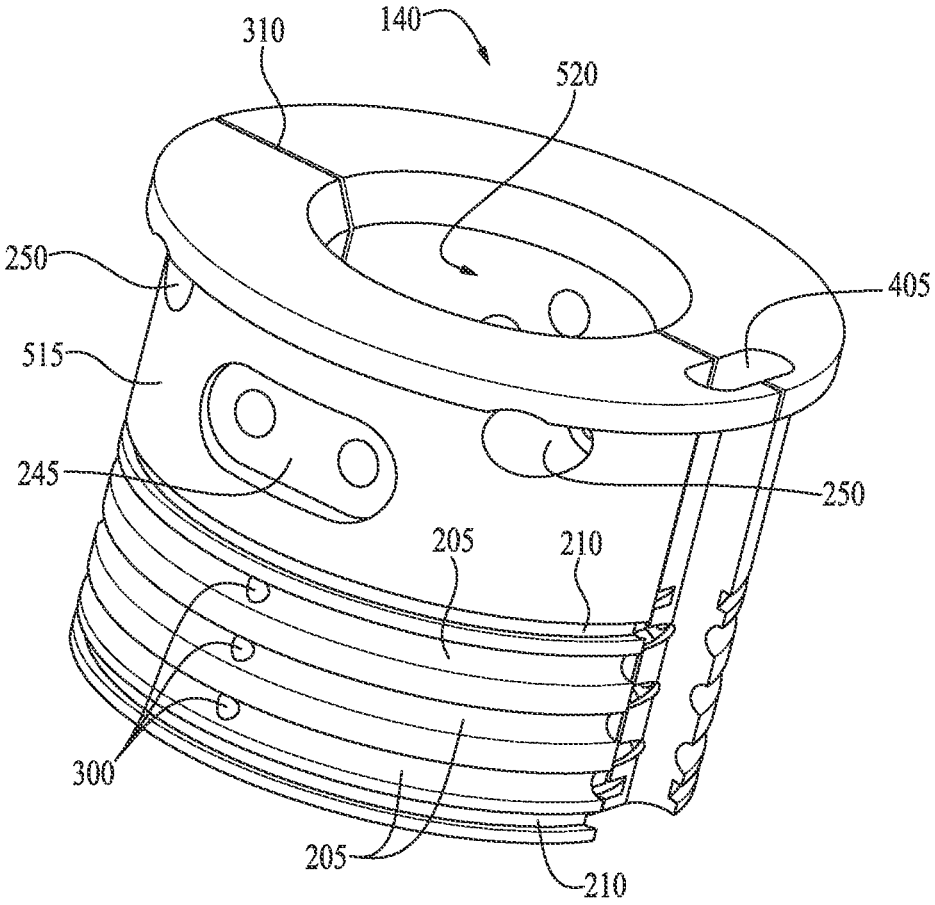
FIG. 3 is a perspective view of a collar of illustrative embodiments.

FIG. 3 illustrates a perspective view of an illustrative embodiment of collar 140. Illustrative embodiments of containment grooves 210, pathways 205, and apertures 300 are shown on the outer surface of collar 140 in FIG. 3. As shown, in FIGS. 2B and 3, apertures 300 may be located on pathways 205 on outer surface 515, and extend through the wall of collar 140 to counterpart pathways 205 on inner surface 520. In such an embodiment, pathways 205 are in opposing positions on inner surface 520 and outer surface 515, such that a single aperture 300 creates a tunnel through the wall of collar 140 between a pathway on inner surface 520 and outer surface 515. In one or more embodiments, collar 140 may include a flange on a downstream side where axial slot 405 may be located as illustrated in FIG. 3.

Figure 4:
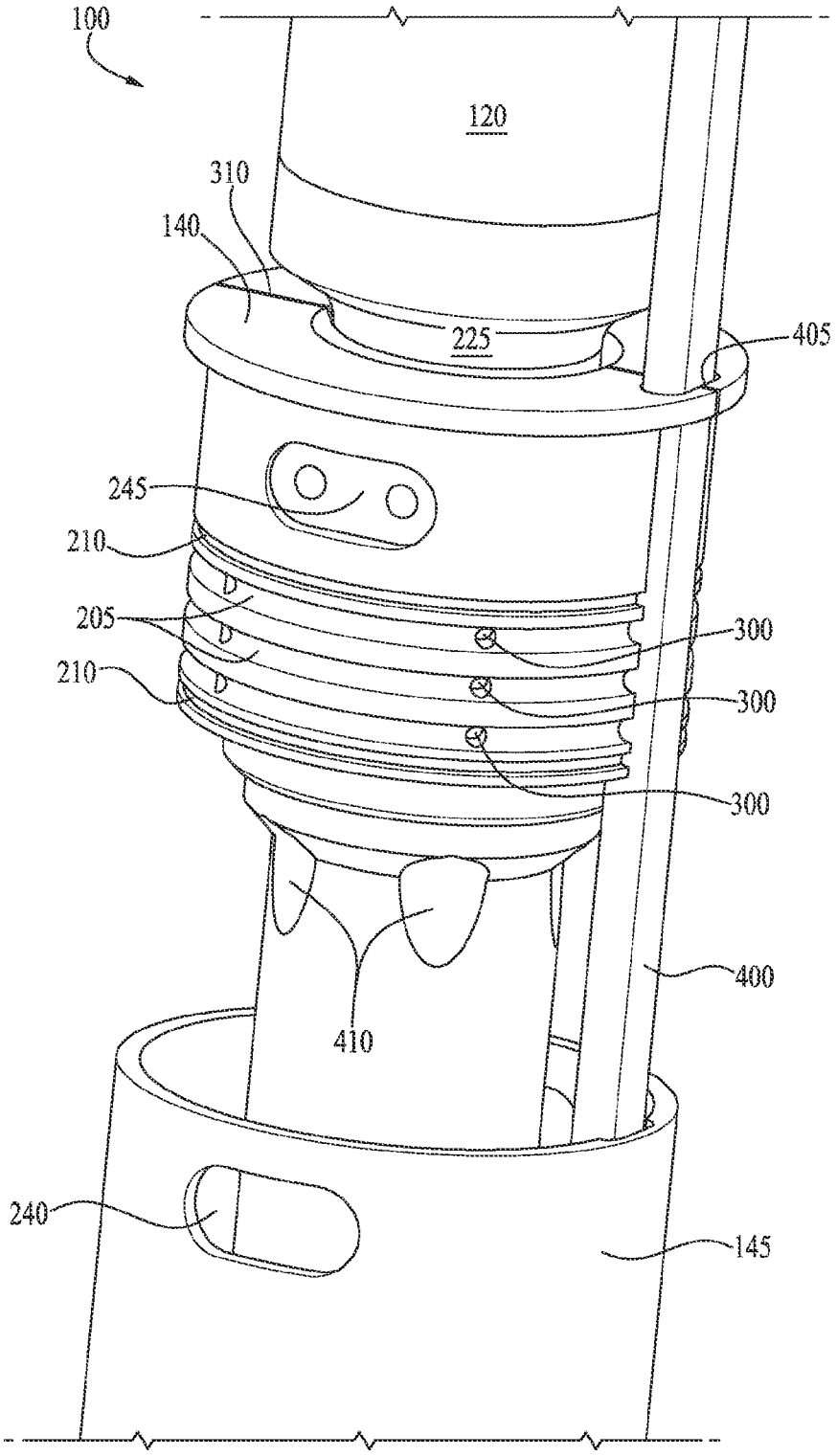
FIG. 4 is a perspective view of an illustrative embodiment of a centrifugal pump base with collar during positioning of a hanger for installation.

ESP assembly 100 including collar 140 may be lowered into hanger 145 during installation, as illustrated in FIG. 4. Hanger 145 may be welded or threaded to jacket 155 (shown in FIGS. 1 and 5), such that once installed, shroud 150 extends from collar 140 at base 225 to the bottom of jacket 155 below motor 105 (shown in FIG. 1). Hanger 145 may be clamped and/or bolted in place onto collar 140 and encase motor lead cable 400, which provides power to motor 105. Hanger 145 may be keyed to collar 140 to assist in securing hanger 145 in place. Hanger 145 may be keyed to collar 140 by inserting a shear key 230 (shown in FIG. 5) into collar mating area 245 and hanger mating area 240 when the mating areas are aligned. As shown in FIG. 4, axial slot 405 in flange of collar 140 may surround motor lead cable 400.

FIG. 5 is an illustrative embodiment of hanger 145 attached to collar 140 on assembly 100. Once hanger 145 is attached, sealant 600 may be inserted, for example poured or sprayed, into shroud 150 through entry port 215 (shown in FIG. 2A) in hanger 145. As shown in FIG. 2A, entry port 215 and nipple 220 may be positioned and/or aligned on an aperture 300 and/or a pathway on outer surface 515 of collar 140 to assist in sealant 600 flow about both inner surface 520 and outer surface 515 of collar 140. Entry port 215 may be an opening in hanger 145, to which nipple 220 may be attached. Nipple 220 may assist in the insertion of sealant into shroud 150. Once sealant has been inserted, nipple 220 may be removed and entry port 215 may be plugged. In some embodiments, sealant may serve to plug entry port 215, and no additional plug may be necessary.

Illustrative embodiments of the invention provide for sealant 600 to seal leaks around centrifugal pump 120, motor lead cable 400 and/or intake 115. As shown in FIG. 6, sealant 600 may be a foam created from an aerosol spray of chemicals that may be inserted into nipple 220 and/or entry port 215. Methods for creating and installing sealant 600 are well known in the art and thus not discussed here so as not to obscure the invention. Sealant 600 may initially be a liquid and/or foam, that cures to a semi-rigid (hardened), closed cell mass. Sealant 600 may expand as it cures, and as it expands may fill areas of shroud 150 otherwise prone to leakage. In one example, sealant 600 may expand by about 50% by volume as it cures, filling and sealing one or more areas 505, 510, 530, 535 during the expansion process. In some embodiments, sealant 600 is a material that seals, caulks, insulates and/or is impermeable to well fluid (e.g., waterproof), for example, a polyurethane foam, steel reinforced epoxy or a silicone glue. Illustrative embodiments of sealant 600 may effectively be inserted and seal leaks in extreme weather conditions, such as at temperatures below 32° F., above 100° F., or anywhere in between. Evercoat, a division of Illinois Tool Works Inc. of Cincinnati, Ohio makes an applicable sealant foam, DAP Products Inc. of Baltimore, Md. makes a polyurethane insulating foam sealant which may be applicable to embodiments of the invention. Brodi Specialty Products Ltd. of Markham, Ontario also makes a polyurethane foam sealant that may provide an exemplary sealant foam suitable for illustrative embodiments.

Sealant 600 may adhere to metal, specifically the carbon steel or stainless steel typically used for intake 115, collar 140 and/or hanger 145, and may expand during the curing process. Sealant 600 may at first be a viscous, semisolid fluid such as a foam. Upon coming into contact with air, moisture, changes in pressure and/or with other ambient changes, the sealant over time cures or hardens, becoming a solid, semi-rigid closed cell mass and/or no longer flows. In some embodiments, sealant 600 hardens in between about 15 and 20 minutes from the initial spray or insertion into shroud 150. While sealant 600 starts as fluid or fluid-like, force from the initial spray-in, pour-in or other insertion technique known to those of skill in the art, and reaction with atmosphere gases, and/or gravity, may cause sealant 600 to flow around and about collar 140, hanger 145, motor lead cable 400, base 225 and/or intake 115. Pathways 205 and apertures 300 assist in guiding sealant 600 to locations that may be prone to leak well fluid, such as areas 505, 510, 530 and 535, and navigating the fluid throughout the inner 520 and outer diameter 515 of collar 140, as well as the inner surface of hanger 145. Due to the initially fluid nature of sealant 600, the sealant may easily flow through cracks and small crevices around pump components. As the sealant expands and hardens, it may bond with pump assembly component surfaces, creating a seal (hardened barrier) from well fluid that is uniquely positioned in otherwise difficult-to-seal locations.

Collar 140, hanger 145 and sealant 600 may be quickly and easily included on pump assembly 100 at the well site, prior to placing pump assembly 100 inside the wellbore. Unlike conventional methods for sealing a shroud that take as long as 2 to 4 hours to intricately place various rubber layers at precise locations, illustrative embodiments may be installed in as little as about 15-20 minutes. First, collar 140 may be clamped into place on base 225 of centrifugal pump 120. In some embodiments collar 140 may be split in two halves to be easily placed around centrifugal pump 120 and to enclose motor lead cable 400, and then bolted to clamp the split collar 140 together. Recesses 250 shown in FIGS. 2A and 3, may accommodate bolts for such purpose. The opposing side of collar 140 may include threads (not shown) so split collar 140 may be bolted together. In some embodiments, collar 140 may be cast in a single solid piece and subsequently be machined into two or more pieces to allow for easy installation. Once collar 140 has been installed, ESP assembly 100 may be lowered into hanger 145, which may be welded and/or threaded to jacket 155. Hanger 145 may be engaged with collar 140 by key 230, clamps and/or bolts. Nipple 220 may then be installed on port 215. Sealant 600 may next be sprayed and/or inserted, for example from sealant can 605, into collar 140, hanger 145 and the surrounding pump components, predominantly around areas proximate intake 115 downstream of intake ports 410. Sealant 600 may be easily sprayed in extreme weather below 32° F., above 100° F. or more moderate weather conditions. FIG. 6 is a perspective view of an illustrative embodiment of insertion of sealant 600 into a submersible pump assembly 100 with collar 140 and hanger 145. Once sealant 600 has been sprayed, nipple 220 may be removed and port 215 may be plugged. In some embodiments, hardened sealant plugs port 215 and no additional plug may be necessary. After the sealant hardens, ESP assembly 100 with shroud 150 may be lowered into the wellbore.

Illustrative embodiments may provide a motor shroud resistant to leaks over a wider surface area than conventional shrouds, which shroud may be simple to install in an expedient fashion at the well site regardless of extreme weather conditions. Thus, the invention described herein provides one or more embodiments of a motor shroud for an electric submersible pump. While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A motor shroud comprising:

a shroud collar secured around a base of a centrifugal pump, the shroud collar comprising a first plurality of sealant pathways extending around an inner surface of the shroud collar and a second plurality of sealant pathways extending around an outer surface of the shroud collar, wherein at least one of the second plurality of sealant pathways has an aperture extending radially through the shroud collar between the inner surface and the outer surface of the shroud collar;

a shroud hanger tubularly surrounding the outer surface and fixedly coupled to a shroud jacket, the shroud hanger comprising a sealant entry port;

the shroud jacket extending below an electric motor that turns the centrifugal pump; and a sealant occupying a first space between the shroud hanger and the shroud collar and a second space between the shroud collar and an intake of the centrifugal pump, wherein the sealant cures from an aerosol spray to form a hardened foam barrier to a flow of well fluid.

2. The motor shroud of claim 1, wherein the sealant comprises a closed-cell polyurethane foam.

3. The motor shroud of claim 1, further comprising a pair of containment grooves sandwiching the second plurality of sealant pathways.

4. The motor shroud of claim 3, further comprising a pair of elastomeric rings inset into the pair of containment grooves.

5. The motor shroud of claim 3, further comprising a second pair of containment grooves sandwiching the first plurality of sealant pathways.

6. The motor shroud of claim 1, wherein the first and second plurality of sealant pathways are grooves machined into the inner and outer surfaces of the shroud collar.

7. The motor shroud of claim 1, wherein the aperture extends radially between one of the first plurality of sealant pathways and one of the second plurality of sealant pathways.

8. A downhole pumping system comprising:

a vertical pump assembly downhole in a well casing, the well casing comprising perforations above an intake of the pump assembly;

a motor shroud extending tubularly about the pump assembly from a base of a centrifugal pump to a pump motor operatively coupled to the centrifugal pump, the tubular motor shroud comprising:

a split collar secured to the base of the centrifugal pump;

a hanger secured around the split collar on a top side and fixedly coupled to a shroud jacket on a bottom side; and a foam sealant expanded into one of a first area between a motor lead cable and the split collar, a second area between the split collar and the intake, a third area between the split collar and the hanger, or a combination thereof;

wherein the foam sealant cures to form a hardened barrier to well fluid, and wherein the well fluid enters the well casing through the perforations and flows inside the tubular motor shroud passed the motor of the pump assembly prior to entering the intake of the pump assembly.

9. The downhole pumping system of claim 8, wherein the split collar further comprises a first sealant pathway extending circumferentially about an outer diameter, and a second sealant pathway extending circumferentially about an inner diameter, the second sealant pathway extending about the inner diameter of the split collar fluidly coupled to the first sealant pathway extending about the outer diameter by an aperture.

10. The downhole pumping system of claim 8, wherein the hanger further comprises a sealant entry port.

11. The downhole pumping system of claim 10, wherein the foam sealant is sprayed through a nipple attached to the sealant entry port.

12. The downhole pumping system of claim 8, further comprising a foam sealant pathway leading to the second area between the intake and the split collar.

13. The downhole pumping system of claim 12, wherein the foam sealant pathway is sandwiched between a pair of containment grooves.

14. The downhole pumping system of claim 8, wherein the hanger is keyed to the split collar.

15. An electric submersible pump (ESP) assembly comprising:

a shroud collar bolted around an ESP, the shroud collar comprising:

an inner surface extending axially on an inner diameter of the shroud collar;

an outer surface extending axially on an outer diameter of the shroud collar;

at least one first circumferential sealant pathway groove extending around the inner surface;

at least one second circumferential sealant pathway groove extending around the outer surface;

at least one aperture extending radially between the at least one first and second sealant pathway grooves;

a first pair of sealant containment grooves sandwiching the at least one first circumferential sealant pathway groove on the inner surface;

a second pair of sealant containment grooves sandwiching the at least one second circumferential sealant pathway groove on the outer surface;

each containment groove of the first and second pair of sealant containment grooves comprising an elastomeric ring fitted therein; and a hardened polyurethane closed-cell sealant adhereingly coupled to the ESP, the at least one first and second circumferential sealant pathway grooves and the at least one aperture.

16. The ESP assembly of claim 15, further comprising a hanger bolted to the shroud collar, and wherein the hardened polyurethane closed-cell sealant is adhereingly coupled to the hanger.

17. The ESP assembly of claim 16, wherein the hanger is one of threaded, welded or a combination thereof to a shroud jacket, the shroud jacket extending below a motor of the ESP.

18. The ESP assembly of claim 15, wherein at least one of the elastomeric rings has an opening around a motor lead cable of the ESP.

* * * * *